United States Patent [19]

Jackson et al.

[11] Patent Number: 4,760,799

[45] Date of Patent: Aug. 2, 1988

[54] LIGHTWEIGHT RAILWAY VEHICLE TRUCK

[75] Inventors: Keith L. Jackson, Creve Coeur; Richard B. Polley, St. Charles, both of Mo.; Dallas L. Schmitt, Fairview Heights, Ill.

[73] Assignee: GSI Engineering, Inc., St. Louis, Mo.

[21] Appl. No.: 29,206

[22] Filed: Mar. 23, 1987

[51] Int. Cl.[4] ..... B61F 5/08

[52] U.S. Cl. ..... 105/182.1; 105/198.2; 105/198.7

[58] Field of Search ..... 105/182.1, 185, 193, 105/197.05, 198.2, 198.4, 198.5, 198.7, 200, 201, 209, 171, 157.1

[56] References Cited

U.S. PATENT DOCUMENTS

| | | | |
|---|---|---|---|
| 3,181,479 | 5/1965 | Rumsey et al. | 105/198.7 X |
| 3,512,482 | 5/1970 | Lich | 105/198.7 X |
| 3,650,219 | 3/1972 | Seely | 105/198.7 X |
| 3,799,066 | 3/1974 | Jackson | 105/182.1 |
| 4,428,301 | 1/1984 | Jackson | 105/198.1 X |
| 4,429,637 | 2/1984 | Jackson et al. | 105/200 X |

FOREIGN PATENT DOCUMENTS

| | | | |
|---|---|---|---|
| 937959 | 1/1956 | Fed. Rep. of Germany | 105/190.2 |
| 1106359 | 10/1956 | Fed. Rep. of Germany | 105/194 |
| 1032303 | 6/1958 | Fed. Rep. of Germany | 105/182.1 |
| 1440566 | 6/1976 | United Kingdom | 105/198.7 |

*Primary Examiner*—Leonard E. Smith
*Attorney, Agent, or Firm*—F. Travers Burgess

[57] ABSTRACT

A railway vehicle truck in which the framing consists of sideframes resiliently supported at their ends on the axle bearings and a main frame supported on the sideframes by flat elastomeric pad devices inclined longitudinally of the truck and located at a substantially higher level than the levels of the neutral axes of the sideframe center portions and of the effective lateral reaction points of the resilient supports of the sideframes on the axles, the position and inclination of the pad devices being such that the horizontal component of the resultant force developed by each pad device on the respective sideframe lies along the neutral axis of the sideframe center portion whereby to place the center portion of the sideframe in tension rather than bending and thereby permit use of sideframes of extremely light construction, and separating lateral thrust means between the sideframes and main frame from the vertical springing function of the inclined pad devices to permit optimum placement of the lateral thrust means, i.e., in the region of the effective level of resilient support of the sideframes on the axles, thereby eliminating substantial lateral overturning moments on the sideframes which would otherwise occur if all lateral thrust between the main frame and sideframes were applied at the level of the inclined pads.

12 Claims, 3 Drawing Sheets

LIGHTWEIGHT RAILWAY VEHICLE TRUCK

BACKGROUND OF THE INVENTION

1. Field of the Invention

The invention relates to railway rolling stock and comprises a light weight passenger car truck having an improved arrangement of means for resiliently supporting the main frame on separate sideframes resiliently supported on the axles and for application of lateral thrusts between the main frame and the sideframes.

2. The Prior Art

The use of inclined flat elastomeric pads to support a main frame or bolster on separate sideframes non-resiliently supported on the axles is disclosed in R. C. Hobson U.S. Pat. No. 3,342,140 in which lateral thrust means consist of flanges on the bolster at a higher level than the elastomeric pads. The use of inclined V-shaped elastomeric pads for supporting a main frame or bolster on non-resiliently supported sideframes is disclosed in F. W. Sinclair U.S. Pat. No. 2,981,208 and other patents, in which the lateral thrust function is performed at the same level as the support function by the V-shaped pads.

SUMMARY OF THE INVENTION

An object of the invention is to provide a truck in which weight may be minimized by supporting its main frame on resiliently supported sideframes in such a way that longitudinal force components between the main frame and sideframes will act along the neutral axes of the sideframes and place the latter in tension rather than bending, and lateral force application between the main frame and side-frames will be near the effective level of the resilient support of the sideframes on the axles so as to avoid tipping of the sideframes from lateral forces applied to them by the main frame.

THE DRAWINGS

DETAILED DESCRIPTION OF THE INVENTION

Figure 1:
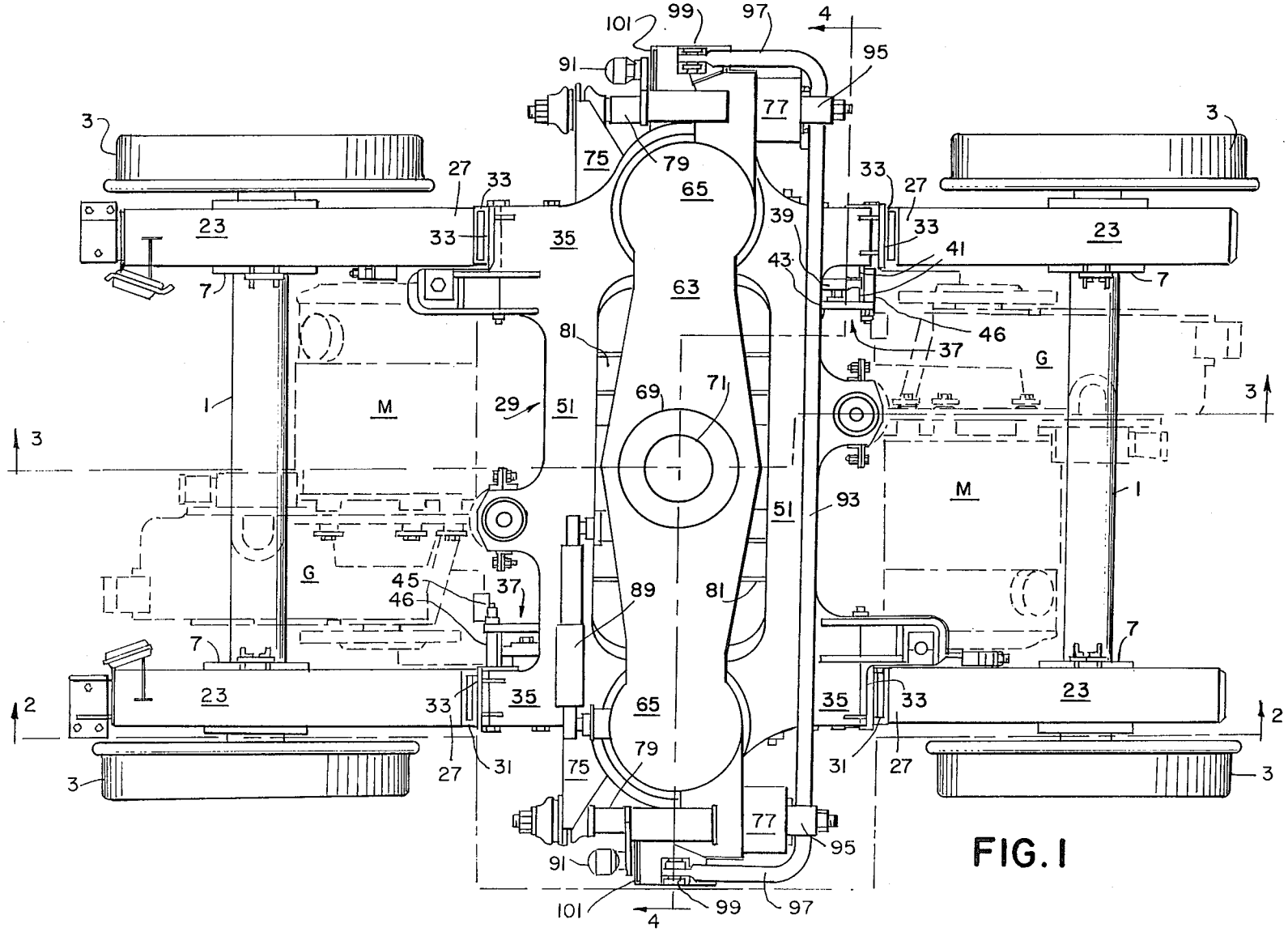
FIG. 1 is a plan view of a railway truck constructed in accordance with the invention.
Figure 2:
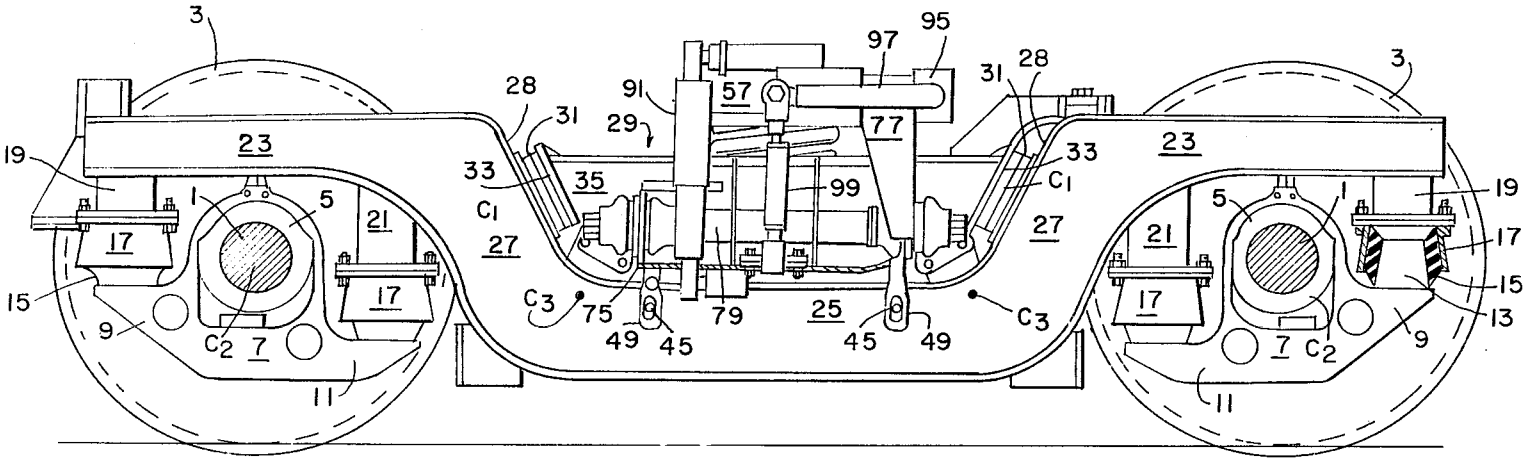
FIG. 2 is a side elevational view of the truck illustrated in FIG. 1, taken from line 2—2 of FIG. 1.
Figure 3:
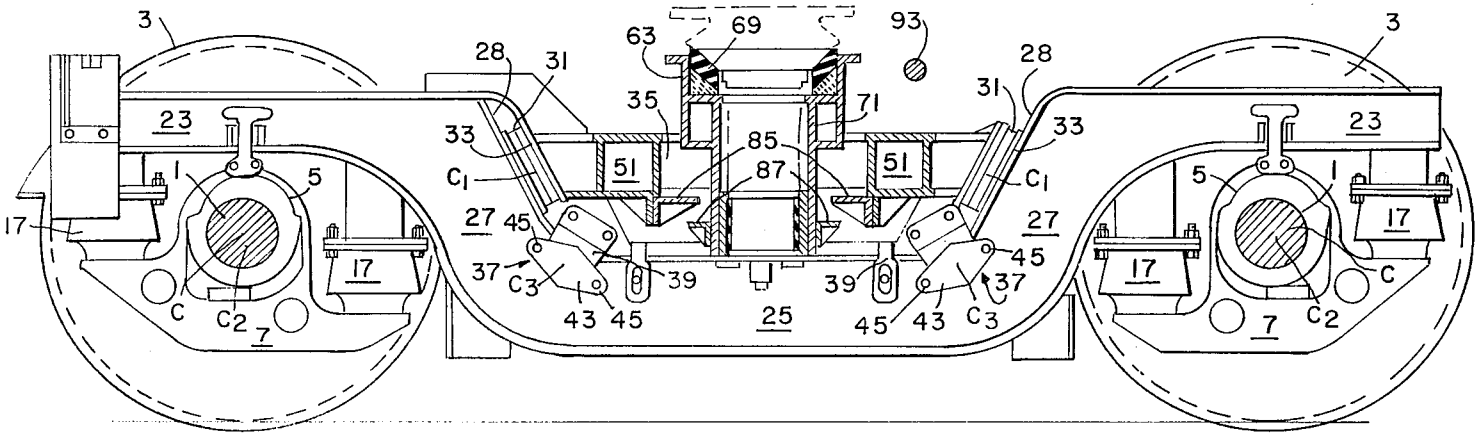
FIG. 3 is a longitudinal vertical sectional view along line 3—3 of FIG. 1.

In the drawings, the numeral 1 denotes each of a pair of railway axles mounting at their ends flanged wheels 3. Axles 1 are rotatably received inboard of each wheel 3 in journal bearings 5, preferably of the antifriction type.

Each bearing 5 is mounted in a journal box 7 having fore and aft wings 9 and 11 each with flat horizontal upper surfaces, the wings 9 near the ends of the truck being at a relatively high level and the wings 11 near the center of the truck being at a substantially lower level.

Primary suspension spring devices, comprising upright frusto-conical elements 13 seated on the respective journal box wings 9 and 11, elastomeric annuli 15 surrounding fructo-cones 13, and complementary-shaped concave frusto-conical elements 17 surrounding the elastomeric annuli, directly support, by means of upright columns 19 and 21, elevated horizontal end portions 23 of sideframes having center portions 25 depressed between said end portions to a level lower than the centers of axles 1 and intermediate sloping portions 27, with upwardly facing inclined surfaces 28, connecting elevated end portions 23 and depressed center portion 25.

A main frame generally indicated at 29 is supported at its sides on sideframes 23, 25, 27 by four inclined elastomeric pad devices 31 seated on the upper inclined surfaces 28 of the sideframes and underlyingly supporting similarly inclined downwardly facing surfaces 33 on main frame longitudinally extending sidemembers whereby tipping of the sideframes in longitudinal vertical plane for equalization is accommodated by a combination of shear and compressive deflection in pad devices 31.

In order to utilize sideframes of optimum efficiency, i.e., of the lightest weight consistent with adequate strength, pad devices 31 are positioned and inclined to eliminate substantial bending moments from the center portion 25 of the sideframes between the effective centers $C_1$ of pad devices 31.

Figure 5:
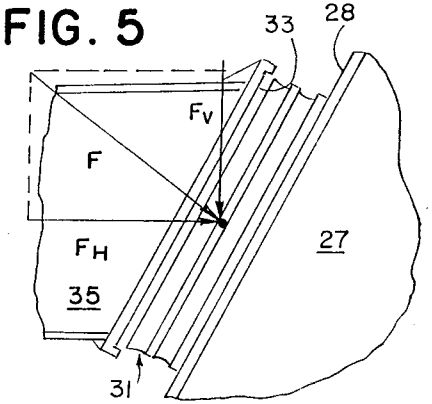
FIG. 5 is a side view of the inclined elastomeric frame-support pads showing resolution of the load applied normal to the pads into vertical and horizontal (longitudinal) force components.

Referring to FIG. 5, it will be evident that resultant load F applied through each pad device to the sideframe is resolved by inclination of the pad devices into a vertical force component $F_V$ and a horizontal force component $F_H$ acting longitudinally of the truck.

Figure 6:
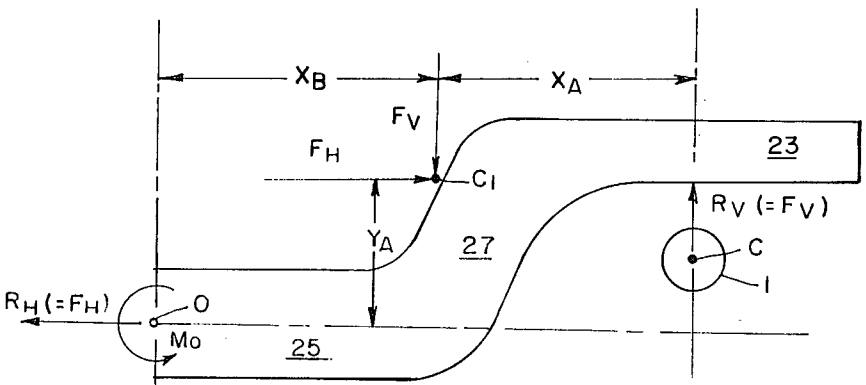
FIG. 6 is a diagramatic side view of a half of a single sideframe under vertical load.

Referring to FIG. 6, it will be seen that the vertical force component $F_V$ from the inclined pad device 31 is reacted by a vertical force $F_V$ through axle center C and the horizontal force component $F_H$ from the inclined pad device is reacted by a horizontal force $F_H$ through the neutral axis O of the sideframe center portion 25. The moment $M_O$ about the neutral axis O of the sideframe center portion 25 is the summation of the products of (1) the vertical force component $F_V$ and the horizontal distance $X_B$ from pad device center $C_1$ to sideframe center portion neutral axis O, (2) the vertical reaction force $F_V$ and the horizontal distance $(X_B+X_A)$ from the axle center C to sideframe neutral axis O, and (3) the horizontal force component $F_H$ and the vertical distance $Y_A$ from pad device center $C_1$ to sideframe neutral axis O. Thus $$M_O=F_VX_B-F_V(X_B+X_A)+F_HY_A=F_HY_A-F_VX_A.$$

By making dimensions $X_A$ and $Y_A$ such that the ratio $Y_A/X_A \approx F_V/F_H$, couples $F_VX_A$ and $F_HY_A$ are equal, and being in opposite directions, one clockwise and the other counterclockwise, bending moment $M_O$ is minimized, preferably to zero, across the entire center portion 25 of the sideframe.

Figure 4:
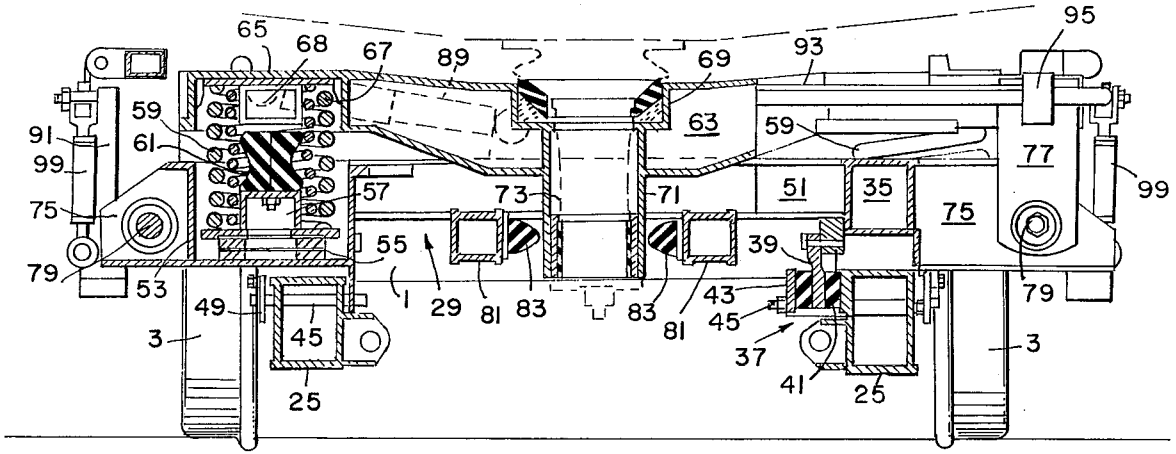
FIG. 4 is a transverse vertical sectional view along line 4—4 of FIG. 1.

In the substantial absence of a bending moment the sideframe center portion 25 will thus experience a substantially pure tensile force $F_H$ and can be of relatively light construction such as the box section best seen in FIG. 4.

It will be evident from the foregoing that the optimum location of inclined pad devices 31 for vertical load support is as described above in which the effective force center $C_1$ of pad devices 31 is well above the effective center $C_2$ of the primary suspension.

Figure 7:
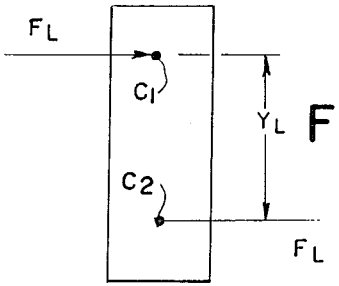
FIGS. 7 and 8 are diagramatic transverse outlines of a single sideframe showing respectively the effects of applying all lateral thrust at the level of the effective center of an inclined main frame-support pad and most of the lateral thrust at a lower level near the level of the effective center of the primary suspension.

Lateral thrusts are applied to axles 1 from the sideframes through the primary suspension at its center $C_2$ and reacted by reason of engagement of the flanges of wheels 3 with the track rails. Referring to FIG. 7, if the entire lateral thrust $F_L$ between the main frame side members 29 and sideframes 23, 25, 27 were applied at the level of the effective center $C_1$ of inclined pad devices 31, located a distance $Y_L$ above the effective center $C_2$ of the primary suspension (i.e., the effective level of support of the sideframes on the axles), a substantial overturning movement $F_LY_L$ would be applied to the sideframes.

It follows that, to eliminate substantially the lateral overturning moment described above, the optimum level of lateral force application between the main frame and sideframes would be at the same level as the primary suspension effective reaction point $C_2$ and that the optimum levels for vertical and lateral force applications are different.

Figure 8:
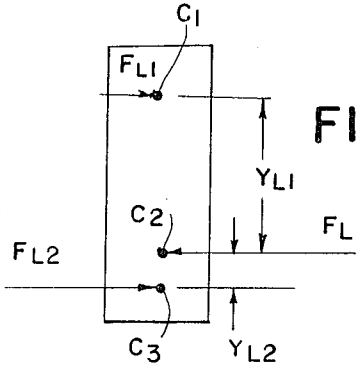

For this reason, the lateral thrust transmitting function between the main frame and sideframes has been separated from the vertical springing function, as may be understood best from FIG. 8, by orienting the inclined pad devices horizontally transversely of the truck so as to minimize their lateral rate and providing separate lateral thrust devices, generally indicated at 37, the effective centers $C_3$ of which are located a distance $Y_{L2}$ below primary suspension effective center $C_2$, such that when thrust $F_{L2}$ applied at this level is added to the small lateral thrust $F_{L1}$ applied by inclined pad devices 31, the resultant lateral force $F_L$ is coplanar with primary suspension effective lateral reaction point $C_2$. This is accomplished by making the distance $Y_{L2}$ such that the moments $F_{L1}Y_{L1}$ and $F_{L2}Y_{L2}$ of $F_{L1}$ and $F_{L2}$ at primary suspension effective center $C_2$ are equal, and since they are in opposite directions, their sum $$\Sigma M = F_{L1}Y_{L1} - F_{L2}Y_{L2} \approx 0.$$

Lateral thrust devices 37 comprise vertical plates 39 depending rigidly from main frame side members 35 and received between elastomeric pads 41 positioned between the respective sideframes, and a flat retainer plate 43 bolted at 45 to the respective sideframes and held in predetermined spaced relation inwardly from the sideframe by spacers 46 so as to maintain pads 41 in compression. Thus pads 41 react to lateral thrusts in compression, while vertical and longitudinal movements of the sideframes relative to main frame 29 are accommodated by the vertical yieldability in shear of pads 41.

Vertical separation of main frame 29 from the sideframes is prevented by the projection of transverse pins 47 fixed in the sideframe center portion 25 into oversize slots in perforated safety hangers 49 depending from main frame side members 35.

In addition to side members 35, main frame 29 also has a pair of transversely extending longitudinally spaced transoms 51, and side members 35 are widened outwardly intermediate their ends to provide cylindrical upwardly open spring pockets 53, in which are seated spring assemblies each consisting of an annular elastomeric sandwich 55, a hat-shaped spring seat 57, and spring group 59 comprising a pair of upright concentric coil springs. A generally cylindrical elastomeric block 61 is supported on the top of each hat-shaped spring seat.

A transverse bolster 63 has downwardly open cylindrical spring pockets 64 formed in its ends 65, in vertical alignment with frame spring pockets 53, and an inverted hat-shaped spring cap 67 in each bolster spring pocket 65 rests on and is received within the respective spring group 59, such that the bolster is cushioned from vertical vibrations of the truck frame by the vertical resiliency of spring groups 59 and against lateral vibrations by the yieldability in shear of elastomeric sandwiches 55.

At its center bolster 63 is formed with a center bearing 69 including a depending cylindrical part 71 adapted to swivelly and supportingly receive a mating bearing 73 of a supported car underframe.

For positioning the bolster 63 longitudinally of the truck and transmitting traction and braking forces between the bolster and main frame 29 while freely accommodating these relative vertical and transverse movements as described above, each sideframe 35 is formed with an outboard bracket 75 and the bolster is formed at each end with a depending outboard bracket 77 in longitudinal alignment with bracket 75, and brackets 75 and 77 are connected by anchor links 79 of the type and in the manner described in J. C. Travilla U.S. Pat. No. 3,315,555.

For limiting relative lateral movement of bolster 63 on main frame 29, transoms 51 of the latter are connected by a pair of longitudinal members 81 spaced on opposite sides from center bearing cylindrical part 71 and mounting elastomeric bumper elements 83 of beehive cross-section engaging the opposite laterally facing surface portions of center bearing cylindrical elements 71.

For preventing vertical separation of bolster 63 from main frame 29, transoms 51 of the latter mount at their centers longitudinally inwardly directed downwardly facing shelf-like brackets 85 and center bearing cylindrical part 71 mounts vertically spaced opposing upwardly facing brackets 87.

For damping lateral and vertical movements of the bolster on the main frame, these elements are connected, respectively, by lateral and vertical shock absorbers 89 and 91.

For limiting roll, a transversely extending torsion bar 93, journaled at its ends in bearings 95 on bolster brackets 77, has its longitudinally extending end portions 97 connected by vertical pitmans 99 to brackets 101 projecting outwardly from the frame spring pockets 53.

Electric motor and drive units M, G may be supported from frame 29 and drivingly connected to axles 1 in any suitable manner.

Operation of the invention is as follows: Axles 1 are retained in tram with respect to sideframes 23, 25, 27 by the resistance to compression in the horizontal plane of primary spring elastomeric annuli 13, sideframes 23, 25, 27 are cushioned against vertical irregularties in the track rails by the yieldability principally in shear in pads 13 of primary springs 13, 15, 17. Additional tipping of the sideframes with respect to main frames 29 and to each other for load equalizing purposes is permitted through shear, in the direction of their inclination, in inclined intermediate pad devices 31 and lateral movements of the main frame are accommodated through lateral shear in inclined pad devices 31. As described above, because of the inclination of each pad device 31, and the vertical distance of each pad device effective center from the neutral axis of the sideframe center portions 25 and the longitudinal distance of the pad device effective center from the axle center line, the bending moments on the center portions 25 of the sideframes are substantially eliminated and the sideframes experience only tensile forces $F_H$.

At the same time, large lateral overturning moments on the sideframes (which would occur if the entire lateral thrusts of the main frame on the sideframes were reacted to at the same high level as the inclined pad devices 31) are avoided by the position of the lateral thrust devices 37 at $C_3$ at a lower level than the lateral reaction points $C_2$ of the primary suspension such that the sum of the moments of $F_{L1}$ and $F_{L2}$ at the lateral reaction points are zero and the resultant lateral thrust $F_L$ is at the same level as the lateral reaction points $C_2$ and the sideframes are stabilized against lateral overturning.

In view of the low lateral shear rate of inclined pad devices 31 because of their horizontal transverse orientation, and in view of the low shear rate of lateral thrust devices 37 in their longitudinal vertical planes, the vertically and laterally acting functions of the two devices are effectively separated, permitting optimum positioning of each device to perform its intended functions.

The details of the construction may be varied substantially without departing from the spirit of the invention and the exclusive use of all such modifications as come within the scope of the appended claim is contemplated.

It will be understood that, in many cases, structural and other practical considerations may prevent the use of precise dimensional and numerical values required to satisfy the equations set forth herein and the consequent reduction of the aggregate moment about the sideframe center portion neutral axis and the lateral overturning moment to zero, and that, throughout the disclosure and claims the terms are to be so interpreted.

We claim:

1. A railway vehicle truck comprising a pair of wheeled axles, resilient means supported from the end portions of said axles, sideframes having end portions supported on said resilient means and center portions depressed to a lower level than said end portions, a main frame having side portions overlying said center portions of said sideframes, flat elastomeric pad means positioned between said sideframes and the ends of said main frame side portions and inclined in opposite directions lengthwise of the truck to provide resilient support of said main frame on said sideframes and to accommodate tipping of said sideframes in their longitudinal vertical planes with respect to said main frame and to each other for load equalizing purposes, said inclined pad means having their effective centers spaced longitudinally of the truck between said axles and the longitudinal center of said sideframes and vertically of the truck from the neutral axes of said sideframe center portions and being inclined such that the summation of moments about the sideframe neutral axis at the sideframe center, consisting respectively of the products of (1) the vertical force component transmitted through the inclined pad device and the horizontal distance from the pad device center to the sideframe center, (2) the vertical reaction force through the point of support of the sideframes on said resilient means and the horizontal distance from the effective centers of said axle-supported resilient means to the sideframe center, and (3) the horizontal force component transmitted through the inclined pad device and the vertical distance from the pad device center to the sideframe neutral plane, is minimized, whereby to eliminate substantial bending moments on said sideframe center portions and place the same in tension, said inclined pad means being oriented horizontally transversely of the truck whereby to minimize lateral thrust between the sideframes and the main frame at the level of said inclined pad means because of the relatively low lateral shear rate of said inclined pad means, and transversely opposing lateral thrust means with a substantially higher lateral rate than said inclined pad means between said main frame and said sideframes, said lateral thrust means being positioned at a lower level than said inclined pad means whereby to produce a resultant lateral force substantially coplanar with the effective lateral reaction point of said axle-supported resilient means and elimination of any substantial lateral overturning moment on the sideframes.

2. A railway vehicle truck according to claim 1 wherein F is the resultant load applied at the effective center of each of said inclined pad means by said main frame, $F_V$ and $F_H$ are the vertical and horizontal components of F, $-F_V$ is the reaction to $F_V$ at the point of support of the sideframes on said resilient means, $X_A$ is the horizontal distance from the effective centers of said pad means from the effective centers of said axle-supported resilient means, $X_B$ is the horizontal distance from the effective centers of said inclined pad means to a transverse section at the center of said sideframe, and $Y_A$ is the vertical distance of the effective center of said inclined pad means from the neutral axis of said sideframe center portions, the inclination of said pad means and the values of $X_A$ and $Y_A$ being such that $Y_A/X_A \approx F_V/F_H$ whereby the sum of moments $F_V X_B$ and $F_H Y_A$ through the effective center of the inclined pad device is equal and opposite to the moment $-F_V(X_A+X_B)$ at the effective center of axle-supported resilient means and their algebraic sum $$\Sigma M_O = F_V X_B + F_H Y_A - F_V X_A - F_V X_B \approx 0.$$

3. A railway vehicle truck according to claim 2, wherein $F_L$ is the total lateral thrust of said main frame on said sideframe, $F_{L1}$ is the lateral thrust of said main frame on said sideframes at the effective centers of the inclined pad means, and $Y_{L1}$ is the vertical distance between the effective centers of said inclined pad means and of effective centers of said axle-supported resilient means, $F_{L1}Y_{L1}$ being the lateral overturning moment at the effective center of said inclined pad means, $F_{L2}$ being the lateral thrust at the level of said lateral thrust means, $F_{L1}+F_{L2}=F_L$, said lateral thrust means being positioned a distance $Y_{L2}$ below the effective center of said axle-supported resilient means, said distance $Y_{L2}$ being such that the moment of $F_{L2}$ at the effective center of said primary suspension is $F_{L2}Y_{L2}$ and $$F_{L2}Y_{L2} - F_{L1}Y_{L1} \approx 0$$

and the net overturning moment applied by the main frame on the sideframes is zero.

4. A railway vehicle truck according to claim 1 wherein said lateral thrust means comprises spaced laterally opposing vertical surfaces on said sideframes and said main frame and flat elastomeric pads between said opposing vertical surfaces, said pads reacting to lateral thrusts in compression and to vertical and longitudinal forces in shear.

5. A railway vehicle truck according to claim 1 wherein said end portions of said sideframes overlie said axles and intermediate sloping portions connect said end and center portions of said sideframes, said inclined flat pad means being mounted on said intermediate sloping portions.

6. A railway vehicle truck according to claim 5, including journal boxes on the end portions of said axles, wherein said journal boxes have longitudinally extending wings and said resilient means comprise separate spring devices supported on said wings and underlying supporting said end portions of said sideframes.

7. A railway vehicle truck according to claim 6, wherein the effective centers of each of said spring devices are positioned such that the effective center of said resilient means lies below the axle center.

8. A railway vehicle truck according to claim 7, wherein the wing of each said journal box longitudinally outward of the respective axle is at a higher level than the other wing of said box, the vertical position of said wings conforming generally to the shape of the end and sloping portions of the respective sideframe.

9. A railway vehicle truck according to claim 8, wherein each of said spring devices has an upright convex conical surface supported on the respective journal box wing, a mating elastomeric bushing seated on said conical surface and a mating concave conical surface supported from the respective sideframe end portion and surrounding said bushing.

10. A railway vehicle truck according to claim 5, wherein said main frame comprises longitudinally extending side portions seated on said inclined pad means and a pair of longitudinally spaced transverse members, said side members being recessed in the sideframe depressions defined by the sideframe center portion and the sideframe intermediate sloping portions.

11. A railway vehicle truck according to claim 10, wherein said main frame side portions are formed with transversely outwardly projecting upwardly open spring pockets mounting upwardly extending spring devices, a transversely extending bolster is seated at its ends on said spring devices and is formed at its center with a body-supporting swivel center bearing.

12. A railway vehicle truck according to claim 11, wherein each said upwardly extending spring device includes an elastomeric pad means and a coil spring in series, said pad means accommodating lateral movements of said bolster relative to said frame through horizontal shear, and cooperating means on said bolster and frame for resisting movement of said bolster relative to said frame longitudinally of the truck while accommodating relative vertical and lateral movements accommodated by said spring device.

* * * * *